United States Patent [19]

Estang

[11] Patent Number: 4,491,847

[45] Date of Patent: Jan. 1, 1985

[54] DEVICE FOR ROTATING AN ELEMENT ABOUT TWO ORTHOGONAL AXES; APPLICATION TO THE ORIENTATION OF A RADAR ANTENNA

[75] Inventor: Bernard Estang, Paris, France

[73] Assignee: Thomson-CSF, Paris, France

[21] Appl. No.: 341,119

[22] Filed: Jan. 20, 1982

[30] Foreign Application Priority Data

Jan. 20, 1981 [FR] France ..... 81 00946

[51] Int. Cl.[3] ..... H01Q 3/08

[52] U.S. Cl. ..... 343/765; 343/766; 74/479; 74/665 C; 74/661

[58] Field of Search ..... 343/765, 766, 763, 757, 343/759, 764, 882; 74/1 R, 665, 25, 96, 847, 479, 661, 665 C; 248/183; 318/8

[56] References Cited

U.S. PATENT DOCUMENTS

| | | | |
|---|---|---|---|
| 2,410,827 | 11/1946 | Langstroth et al. | 343/765 |
| 2,651,721 | 9/1953 | Bergey et al. | 343/765 |
| 2,797,374 | 6/1957 | Atton et al. | 343/766 |
| 2,930,255 | 3/1960 | Bryson | 343/757 |
| 3,530,477 | 9/1970 | Jarrett et al. | 343/766 |
| 4,238,802 | 12/1980 | Speicher | 343/765 |

FOREIGN PATENT DOCUMENTS

| | | | |
|---|---|---|---|
| 1070565 | 7/1954 | France | 343/766 |
| 2404929 | 4/1979 | France | 343/765 |

*Primary Examiner*—Eli Lieberman
*Assistant Examiner*—Michael C. Wimer
*Attorney, Agent, or Firm*—Oblon, Fisher, Spivak, McClelland & Maier

[57] ABSTRACT

The central part of the nut of a gimbal mounting system for rotating a microwave antenna and the like is given a movement of elevation about the second axis (5) when the corresponding motor (II) is started-up and a circular movement about the first axis (3) orthogonal with the second axis when the corresponding motor (I) alone is started up, said circular movement automatically producing a movement of elevation about the second axis.

4 Claims, 3 Drawing Figures

DEVICE FOR ROTATING AN ELEMENT ABOUT TWO ORTHOGONAL AXES, APPLICATION TO THE ORIENTATION OF A RADAR ANTENNA

This invention relates to a device for rotating an element about two orthogonal axes of rotation, more particularly applied to the orientation of a radar antenna and a radar antenna orientated by such a device.

In order to orient particularly heavy systems or to increase the orientation speed, it is necessary to make use of increasingly powerful drive mechanisms and to minimize the weight of moving parts.

In known types of orientation devices, each axis of rotation has its own motor-drive mechanism for actuating a platform which carries the following rotation axis and its motor. Since certain mechanisms are placed on movable portions, the use of motor-drive mechanisms which are more powerful and therefore heavier has the effect of slowing-down these movements.

SUMMARY OF THE INVENTION

The aim of the present invention is to overcome the disadvantages mentioned in the foregoing.

An object of the present invention is a device for orienting an element about two orthogonal axes in which the motor-drive mechanisms are installed on stationary portions.

Another object of the invention is an orientation device where a large useful volume is made available by virtue of the displacement of the motor-drive mechanisms to a stationary portion.

The device, according to the present invention, for rotating an element about a first axis and a second axis which is orthogonal to the first one and carried by it, including a stationary part and a movable part, a first and a second motor-drive mechanism, placed in the stationary part, for controlling through a first and a second gearing means the rotating movement about said first and second axes respectively, the rotation movement about the second axis is actuated by the corresponding second motor-drive mechanism or together with the rotation movement about the first axis by the corresponding first motor-drive mechanism through a third gearing means.

BRIEF DESCRIPTION OF THE DRAWINGS

These and other features of the invention will be more apparent to those skilled in the art upon consideration of the accompanying drawings, wherein.

DETAILED DESCRIPTION OF THE PREFERRED EMBODIMENTS

Figure 1:
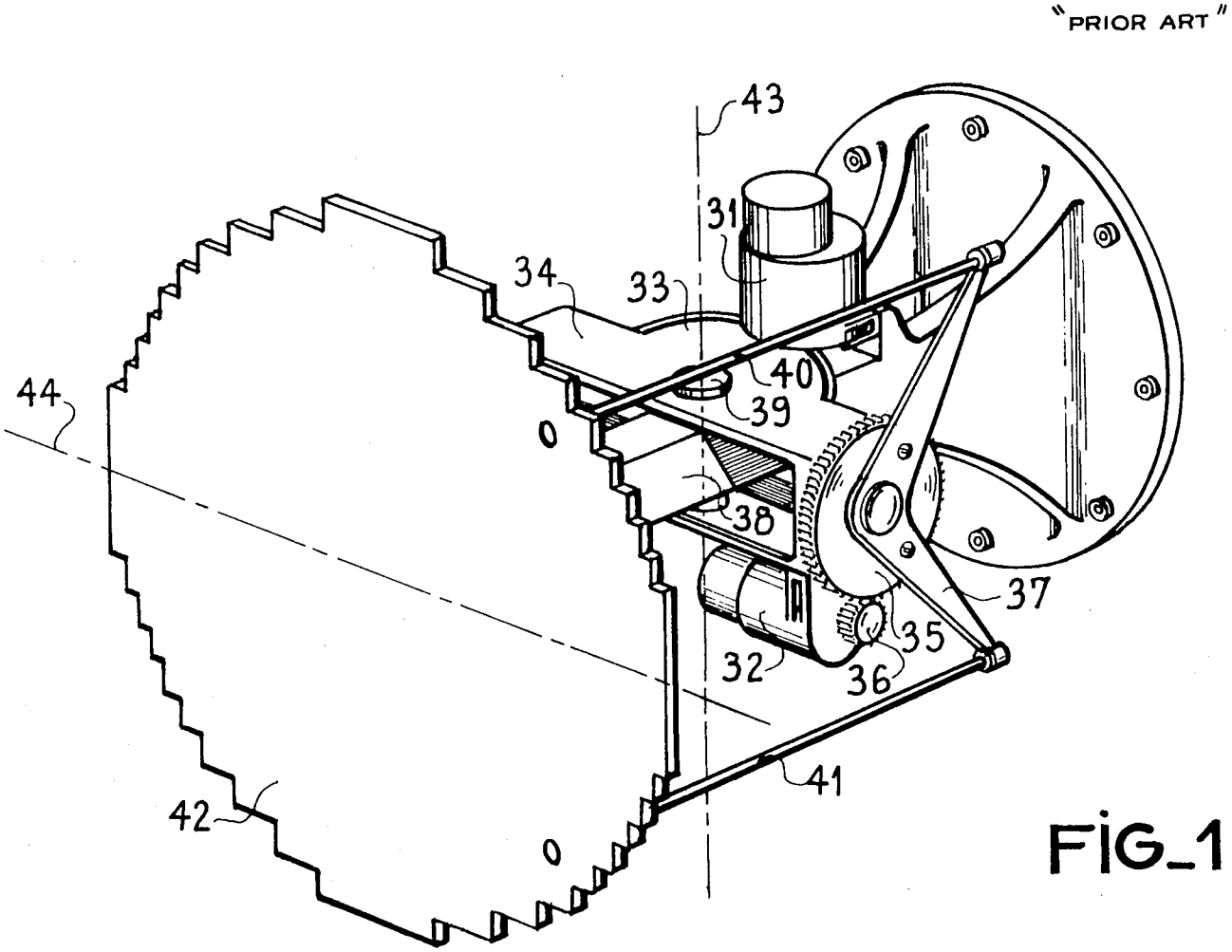
FIG. 1 is a view in perspective showing an orientation device according to the prior art.

The perspective view of FIG. 1 illustrates a device according to the prior art for orienting a radar antenna. In this device, the motor 31 drives a pinion (not shown in the figure) which engages with the toothed portion 33 of a member 34. Said member 34 is adapted to carry a motor 32 and a gear-wheel 35 which is disposed in meshing engagement with a pinion 36 driven by the motor 32. The apex of a V-shaped member 37 is fixed on the external diameter of said gear-wheel 35. The two arms of said V-shaped member are each pivotally attached to one end of a rod designated respectively by the reference numerals 40 and 41. The other end of each rod is pivotally attached to a point of the surface of the antenna 42 to be oriented. Said antenna is also maintained at its center by means of a member 38 which is capable of pivotal motion with respect to the member 34 about the pivot 39.

The two motors 31 and 32 therefore serve to orient the antenna 42 by displacing this latter in pivotal motion with respect to two axes 43 and 44 respectively, that is, with respect to the axis 43 by pivotal displacement of the member 34 about the pivot 39 and with respect to the axis 44 by pivotal displacement of the member 37 and therefore of the gear-wheel 35. However, the circular displacement of the antenna about the axis 43 is slowed-down by the inertia of the weight of the motor 32.

The present invention makes it possible to overcome the drawback just mentioned.

Figure 2:
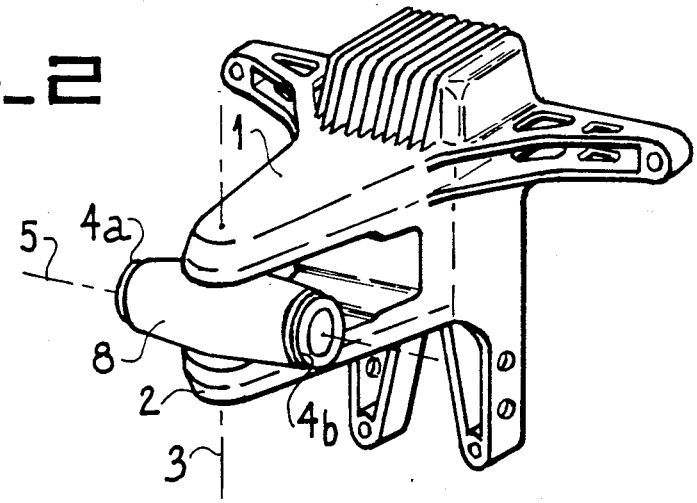
FIG. 2 is a view in perspective showing the orientation device according to the invention.

The device according to the invention as shown in perspective in the general view of FIG. 2 comprises a stationary portion having the shape of an elongated C, the two arms 1, 2 of which constitute the first supporting member of the gimbel mounting system, and a movable portion 4*a*, 4*b* 8 forming the central junction assembly designated as the gimbal nut, the longitudinal axis 5 of which constitutes one of the two orientation axes. Said gimbel nut is composed of a cylindrical element 4*a*, 4*b* and of a coaxial external structure 8, from which the element 4*a*, 4*b* is decoupled and within which said element is capable of pivotal displacement about the common longitudinal axis 5. The structure 8 is in turn capable of pivoting about the first axis 3 at right angles to the second axis 5 between the arms 1 and 2 of the stationary portion.

Figure 3:
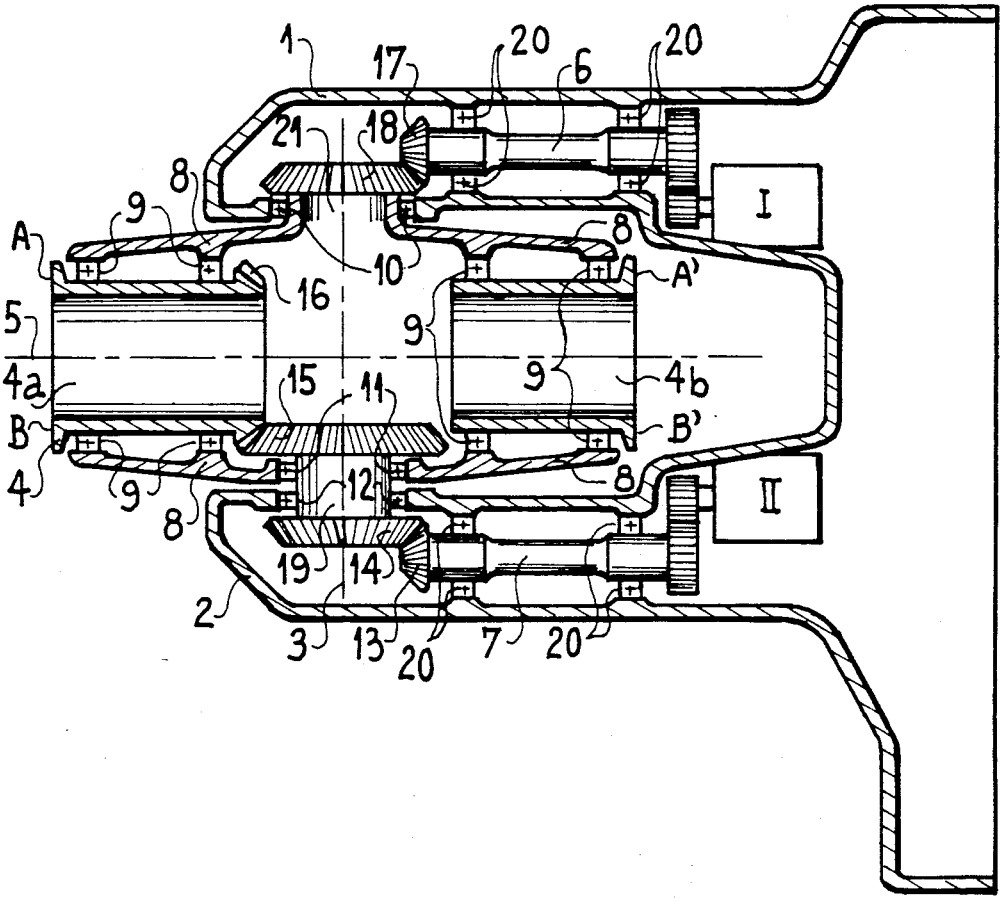
FIG. 3 is a sectional side view of the device shown in FIG. 2.

FIG. 3 is a sectional side view of FIG. 2 after the structure 8 has been displaced in pivotal motion about the axis 3 through an angle of 90°.

The arm 1 of the stationary portion houses the motor-drive mechanism I which controls the so-called circular motion of the system to be oriented. Said mechanism is coupled to a transmission shaft 6 which is placed within the interior of the arm 1 and rotatable within this latter by making use of bearing means 20. The opposite end of the transmission shaft 6 produces action on a bevel coupling formed by a pinion 17 mounted at the end of the shaft 6 and a gear-wheel 18 having an axis 3 at right angles to the axis of the pinion 17 and of the shaft 6. Said gear-wheel 18 is placed within the interior of the arm 1 and is coupled with the structure 8 through the wall of the arm 1 by means of the cylindrical member 21 which forms one of the points of pivotal attachment of the structure 8 to the stationary portion. Rotation of said cylindrical member 21 is effected by making use of bearing means 10 provided in the wall of the arm 1 through which said cylindrical member passes. A cylindrical portion is placed within the interior of the structure 8 and is formed by two separate and distinct hollow elements 4*a* and 4*b* of cylindrical shape located on each side of the axis 3. These two elements 4*a* and 4*b* have an axis 5 which is common with the external structure 8 and are decoupled from this latter by means 9.

The arm 2 of the C-shaped stationary portion houses the motor-drive mechanism II which controls the so-called movement of elevation of the system to be oriented. This mechanism is connected to a transmission shaft 7 placed within the interior of the arm 2 and decoupled from this latter by means 20. The opposite end of the shaft 7 produces action on a bevel coupling housed within the arm 2 and formed by a pinion 13 mounted at the end of the shaft 7 and by a gear-wheel 14 having an axis 3. By means of a cylindrical member 19 having an axis 3, the first bevel coupling drives a second bevel coupling placed within the interior of the structure 8 and comprising a gear-wheel 15 having an axis 3 and disposed in meshing engagement with a gear-wheel 16 having an axis 5 and placed at the periphery of the cylindrical element 4*a*. The cylindrical transition member 19 passes through the wall of the arm 2 and is decoupled from this latter by means 11.

The system to be oriented (not shown in the drawings) is fixed at A, B and A', B' on the cylindrical elements 4*a* and 4*b* respectively, externally of the structure 8, and constitutes the second supporting member of the gimbal mounting system.

If current is supplied to the motor-drive mechanism II alone, only the so-called movement of elevation about the axis 5 is initiated.

In fact, the gear-wheel 14 and the gear-wheel 15 which are coupled together by means of the cylindrical member 19 are driven in rotation from the motor II by means of the shaft 7 fitted with the pinion 13. The gear-wheel 15 engages with the gear-wheel 16 and causes the element 4*a* to rotate about the axis 5. The system which is attached to said element 4*a* also pivots about said axis and is accompanied by a movement of rotation of the element 4*b* in synchronism. The elements 4*a* and 4*b* are rotatable relative to the structure 8, however, and said structure remains motionless. No movement in azimuth therefore takes place.

On the other hand, if current is supplied to the motor-drive mechanism I alone, there takes place both a circular movement about the axis 3 and a movement of elevation about the axis 5 at the same time.

By means of the shaft 6 fitted with the pinion 17, the motor I in fact has the effect of driving the gear-wheel 18 in rotation about the axis 3 and consequently causing rotational motion both of the structure 8 to which said gear-wheel is attached and of the elements 4*a* and 4*b* which are placed within the interior of the structure, and therefore of the system to be oriented. This is the circular movement about the axis 3. By virtue of the bearing means 11 aforementioned, however, the structure 8 is rotatable relative to the cylindrical member 19, with the result that said member and therefore the gear-wheel 15 which is attached to this latter are accordingly motionless since the motor-drive mechanism II is not supplied with current. Since the element 4*a* and therefore the gear-wheel 16 rotate about the axis 3, taking into account the circular movement of the structure 8, the gear-wheel 16 must undergo a displacement along the gear-wheel 15 having an axis 3 with which it is in contact, thus producing a movement of rotation of the element 4*a* about the axis 5 and consequently a movement of rotation of the system to be oriented as well as a movement of rotation of the element 4*b*. This is the movement of elevation about the axis 5.

Means such as rate gyros or annular digital coders placed between stationary portion and movable portion serve to determine and to measure the circular movements and movements of elevation, thus making it possible to control the driving mechanisms in consequence.

The movement of elevation can be cancelled when the circular-motion drive mechanism I is supplied with current. In fact, it is only necessary to ensure that the gear-wheel 15 is driven by means of the motor-drive mechanism II at the same time and by the same angular quantity as the gear-wheel 18 in order to neutralize the relative motion of the two gear-wheels 16 and 15.

In a preferential embodiment, the drive mechanisms can be reduction-gear motor units.

The decoupling means 9, 10, 11, 12, 20 may consist, for example, of ball-bearings.

The device according to the invention can be used in particular for orientating a radar antenna.

It is in fact necessary to provide for the possibility of rapid orientation about two axes. When making use of an orientation device of the prior art, the drive mechanisms placed within the movable portions occupy a volume which could be used to greater advantage for housing microwave rotating joints. By reason of the lack of available space for rotating joints, the microwave receiver is placed in this case as close as possible to the antenna. As a general rule, the receiver is therefore mounted against the back of the antenna and is subjected to very strong vibrations. Furthermore, it produces additional inertia during antenna movements and the motors mounted on movable portions impose limitations on the diagrams of angular displacement of antennas.

By means of the orientation device according to the present invention, the drive mechanisms which are installed on stationary portions permit antenna displacements of substantial amplitude. Furthermore, they free the volume which is located at the center of the gimbel mounting system and which can thus accommodate rotating joints. The microwave receiver can accordingly be displaced to the stationary portion in which the vibrational environment is less severe.

The applications of this device are not limited to the example mentioned in the foregoing but extend to all cases of two orthogonal movements such that one movement is carried by the other, in which the drive mechanisms should preferably be located in the stationary portion of the device.

What is claimed as new and desired to be secured by Letters Patent of the United States is:

1. A device for rotating a driven element about mutually perpendicular first and second axes, said device comprising:

a stationary part;

a movable part rotatable about said first axis;

first and second elements in parallel with said second axis and supporting said driven element, said first and second elements being rotatably mounted within said movable part;

first and second motor drive mechanisms in said stationary part;

first transmission means mounted in said stationary part and rotatable relative thereto said first transmission means being connected to said movable part for rotating said movable part about said first axis and thus rotating said driven element about said first and second axes and being coupled to said first motor drive mechanism;

second transmission means mounted in said stationary part and extending into said movable part, said second transmission means being rotatable relative to both said stationary and movable parts and being coupled to said second motor drive mechanism; and a third transmission means rotatably mounted in said movable part, said thrid transmission means being connected to said second transmission means and rotating said first and second elements about said second axis.

2. A device according to claim 1 wherein said first and second transmission means each include a transmission shaft the rotation of which is controlled by one of said first and second motor drive mechanisms and a first pinion mounted at the end of said transmission shaft opposite to said first and second motor drive mechanisms and meshing with a first gear-wheel parallel to said first axis.

3. A device according to claim 1 wherein said third transmission means includes a second gear wheel integral with said first gear-wheel of said second transmission means and meshing with a third gear-wheel integral with said first element rotatable about said second axis inside said movable part.

4. A device according to claim 1 including a cylindrical element which crosses between said stationary and movable parts, which rotates about said first axis and which is integral with said first gear-wheel of said first transmission means.

* * * * *